United States Patent [19]

Knudson

[11] Patent Number: 4,794,962

[45] Date of Patent: Jan. 3, 1989

[54] VENEER CLIPPER

[75] Inventor: Robert M. Knudson, Coquitlam, Canada

[73] Assignee: MacMillan Bloedel Limited

[21] Appl. No.: 178,930

[22] Filed: Apr. 7, 1988

[51] Int. Cl.[4] ..... B27L 5/00

[52] U.S. Cl. ..... 144/357; 83/368; 83/371; 144/3 R; 144/209 B; 144/211; 144/365; 144/367; 364/474.09

[58] Field of Search ..... 364/474; 144/209 R, 144/209 A, 211, 213, 365, 356, 357, 367, 3 R, 209 B; 83/368, 371

[56] References Cited

U.S. PATENT DOCUMENTS 3,244,206 4/1966 Bossen ..... 144/209 R 4,732,183 3/1988 Barnes ..... 144/357

*Primary Examiner*—W. Donald Bray

*Attorney, Agent, or Firm*—C. A. Rowley

[57] ABSTRACT

A system for clipping veneer, peeled with curved side edges one longer than the other, into discrete full and partial panels each defined by a longer and shorter curved side edge and a leading and trailing edge, wherein the angle of the clipping knife to the direction of travel of the veneer is adjusted during passage of the peeled veneer to clip the veneer into full panels having their leading and trailing edges substantially parallel and partial panels each having its trailing edge at an acute angle to its leading edge and flowing from its shorter curve side to its longer curve side to tend to equalize the accumulated lengths of the curved side edges of the peeled veneer.

7 Claims, 2 Drawing Sheets

VENEER CLIPPER

FIELD OF THE INVENTION

The present invention relates to the clipping of peeled veneer into discrete portions, more particularly the present invention relates to a system for clipping taper peeled veneer having one side edge longer than the other, by adjusting the angular position on the clipping knife relative to the path of travel to compensate for the curving of the veneer.

BACKGROUND ON THE PRESENT INVENTION

In the production of veneer particularly for the manufacture of plywood, it is customary to peel a bolt of wood on a lathe using a cutting edge substantially parallel to the axis of rotation of the bolt thereby to produce a length of veneer with both side edges essentially the same length so a uniform thickness veneer with little or no tendency to curve is produced.

A system has recently been devised for tapered peeling veneer to increase the yield from a log or bolt and improve, for some purposes, the quality of the veneer being produced. Such a system is described in Canadian Application No. 535,219 filed Apr. 21, 1987 by Barnes (U.S. Application No. 040,331 filed Apr. 21, 1987 by Barnes now U.S. Pat. No. 4,732,183).

When veneer is peeled on a taper as defined in the Barnes application the side edge of the veneer cut at the larger diameter end of the bolt is longer than the side edge of the veneer formed from the smaller diameter end of the bolt. Veneer cut in this manner tends to curve and cannot be clipped in the conventional manner if the main advantages of tapered peeling are to be better ensured.

In a companion application filed by D. Barnes on the same day as this application a clipping strategy is described that improves the quality of the veneer sheets and yield but wherein a significant amount of veneer is not available for plywood.

BRIEF DESCRIPTION OF THE PRESENT INVENTION

It is an object of the present invention to provide a clipping system for taper peeled veneer wherein a clipper knife is adjusted as the veneer travels therepast, to reorient the knife relative to the normal path of travel of a straight veneer and clip the veneer into full and partial veneer panels and compensate for the difference in length of the two side edges of the curved veneer.

Broadly, the present invention relates to clipping a curved veneer having one side edge longer than the other side edge into discrete full or partial panels each defined by pair of opposed curved side edges one longer than the other and a leading and trailing end edge comprising adjusting the angle of a clipper knife to the normal path of travel of a straight veneer to clip the veneer into full veneer panels each having its leading and trailing edges substantially parallel and into partial panels each having its trailing edges at an acute angle to its leading edge flaring from its shorter curved side towards its longer curved side to provide a correction for the difference in length between said shorter and longer sides.

Preferably, said acute angle of each parallel panel formed will be substantially the same and preferably said acute angle will be between 1° and 5°, most preferably between 2° and 3°.

The present invention will normally comprise means for sensing bolt to determine the size (diameter) of the bolt and its taper, means to position said bolt for rotation on an axis of rotation based on the size and taper of said bolt sensed by said sensing means, means to rotate said bolt on said axis of rotation, a peeling knife, means to adjust the angle of said peeling knife to the axis of rotation of said bolt in accordance with the sensed taper of said bolt thereby to peel a veneer having a longer and a shorter side edge, a clipper knife closely coupled relative to said peeling knife along the path of travel of said veneer from said peeling knife, computer means for determining the cumulated differences in length between said longer and said shorter side edges based on the size of said bolt, the cutting angle of said peeling knife and the position of said peeling knife, means to angularly adjust said clipper knife to said axis of rotation in accordance with the difference in lengths of said two sides of said peeled veneer as determined by said computer means to position said clipper knife to clip full panels having leading and trailing edges substantially parallel or partial panel having their trailing edge at an acute angle to their leading edge and flairing from their shorter side to their longer side to provide corrections for the accumulated differences in length between said shorter and said longer sides of said peeled veneer.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF PREFERRED EMBODIMENTS

Figure 1:
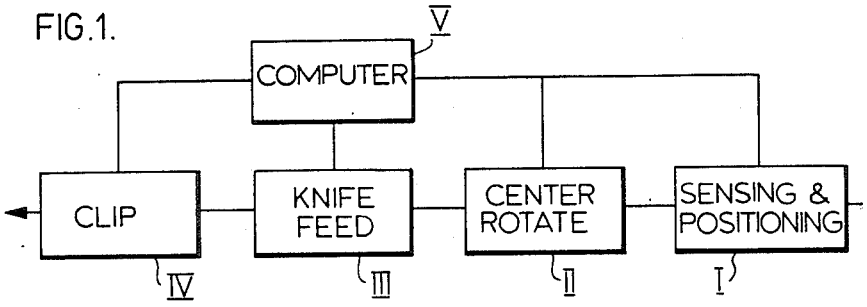
FIG. 1 is a schematic illustration of the operation of the present invention.

FIG. 1 schematically illustrates via a box diagram various steps to accomplish the desired results of the present invention. In the preferred arrangement, the wood bolt to be processed is first sensed in sensing and positioning station I wherein the diameter of the bolt is determined as well as its taper shape. The bolt is then positioned in accordance with the information obtained at station number 1 and mounted in the centering and rotating section II with the selected longitudinal axis of the bolt forming the axis of rotation. The peeling knife feed indicated by box III is controlled in accordance with the axis of rotation of the bolt so that the cutting edge of the knife is correlated with the taper of the bolt to position the cutting edge of the knife at an angle to the axis of rotation and peel a veneer that is longer on one side than the other. This veneer then clipped in clipping station IV in a selected pattern as will be described in more detail hereinbelow. The computer section V correlates the input from the various stations to control the operation of the station to cut and clip the veneer.

Devices represented by the boxes I, II and III may be essentially the same as those described in said Barnes application, however, the clipping station IV which forms an important portion of the present invention is significantly different as is the computer station V which must also control the clipping station IV.

Figure 2:
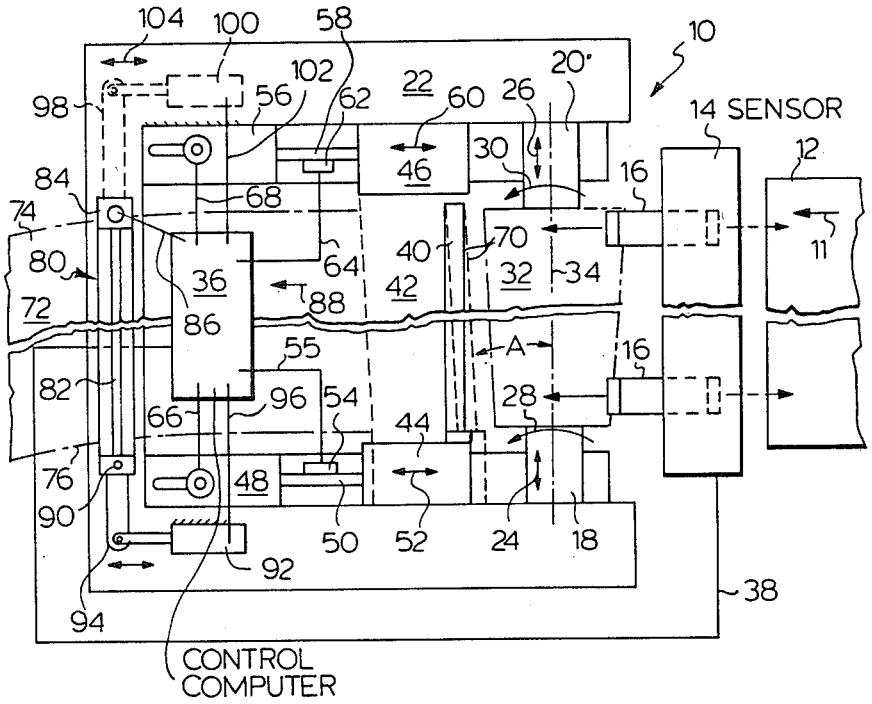
FIG. 2 is a schematic plan view of a lathe adapted to cut on a taper close coupled with a clipper incorporating the present invention.

Referring to FIG. 2 the general layout of the various stations is shown in more detail. Wood bolts are fed to the lathe 10 on a suitable infeed layer 12 in a direction as indicated by the arrow 11 with their longitudinal axes substantially perpendicular to the direction of travel 11. The bolts first pass into a sensor 14 that determines the size and shape of the bolt, i.e. the diameter and taper. The bolt is then oriented via a positioner 16 on a selected axis of rotation based on information sensed by sensor 14 and then moved into position in the lathe where it will be rotated for peeling. In this case the bolt is oriented and positioned by positioner 16 between movable chucks schematically indicated as 18 and 20 mounted in the frame 22 of the lathe for axially movement as indicated by the arrows 24 and 26 rotation as indicated by the arrows 28 and 30. A bolt as such indicated at 32 is held in and rotated by the chucks 18 and 20 on its rotational axis as indicated at 34.

The information obtained in the sensor 14 is used to position the bolt 32 in the chucks 18 and 20, i.e. align the selected longitudinal axis of the bolt on the rotational axis 34 defined by the lathe chucks 18 and 20.

Control computer 36 receives information via line 38 from the sensor 14 and controls the feed of peeling knife schematically illustrated at 40 in accordance with the sensed shape and axis of rotation 34. The peeling knife 40 is mounted on knife carriage 42 the opposite ends of which are mounted on sides 44 and 46 respectively.

The block 44 is driven by a suitable drive such as a hydraulic cylinder means 48 and piston rod 50 which is connected to the block 44 to the move block 44 toward and away from the axis of rotation 34 of the bolt 32 as indicated by the arrow 52. Movement of the shaft or piston rod 50 is measured by a suitable measuring means 54 which communicates this information to the control computer 36 so that the position of the block 44 is known. Similarly, the hydraulic cylinder 56 operates the shaft or piston rod 58 to move the block 46 toward and away from the axis 34 as indicated by the arrow 60. The sensor 62 senses the movement of the piston rod 58 and this information is fed to the control computer 36 via line 64 so that the position of the block 46 is known.

The control computer 36 independently controls via lines 66 and 68 the hydraulic cylinders or drives 48 and 56 respectively so that each end of the knife 40 is independently advanced and the angle of the cutting edge 70 of the knife 40 is adjusted relative to the axis of rotation 34 of the bolt 32 so the knife 40 peels at the desired angle to the axis 34.

When a tapered log or bolt 32 is centered for rotation on rotational axis 34 the knife blocks 44 and 46 are independently advanced to bring the cutting edge 70 into proper cutting angle relative to the axis 34 in accordance with the information provided by the sensor 14. With the larger end of the bolt 70 mounted in the chuck 20 the block 44 is advanced toward the axis 34 relative to the block 46, i.e. to the dash line position illustrated in FIG. 2 so that the cutting edge 70 is now at an angle A to the axis 34. This angle A is determined by the shape of the log or bolt 32 turning in the lathe as described in the said Barnes application to peel either a uniform thickness veneer or tapered cross-section veneer widening from the small diameter end of bolt 32 toward the larger diameter end of bolt 32.

Cutting edge 70 will normally be in the horizontal plane containing the axis 34 and the angle A is measured in that plane.

The angle A may be adjusted in accordance with various scenarios as defined in the said Barnes application, however, the present invention is concerned with those scenarios wherein the angle A is an acute angle and the bolt 32 is cut on a taper so that the veneer schematically illustrated at 72 has a long edge 74 and a shorter edge 76 with longer edge 74 being cut at the end of the knife 40 adjacent to the larger diameter end of the block or bolt 32, i.e. at the maximum radius of the taper cut, and the shorter edge 76 formed at the opposite end of the knife 40, i.e. at the end of the knife 40 closer to the axis of rotation 34.

The clipper indicated at 80 includes a clipper knife schematically illustrated at 82 moved to and from clipping position via a motor or the like indicated at 84 the timing of which is controlled by the computer control 36 via line 86 as will be described in more detail hereinbelow.

Clipper mechanism particularly the blade 82 is mounted in a suitable manner so that its angular relationship to the path of travel of the veneer 72 can be adjusted as required, i.e. change its angle to the path of travel as indicated by the arrow 88 of a veneer cut with the peeling edge 70 substantially parallel to the axis of rotation 34, i.e. in the path 88 is substantially perpendicular to the axis 34.

In the illustrated arrangement this angular adjustment is obtained by mounting the clipper 80 on the frame 22 on a pivot pin 90 to the frame and pivoting the clipper 80 on the axis 90 by a piston and cylinder 92 connected to an arm 94 extending from the clipper 80. The operation of the piston and cylinder 92 is controlled via the control computer 36 through line 96 to move the arm 94 as indicated by the arrow 95 thereby angularly positioning the blade 82 relative to the path of travel 88 in a manner that will be described in more detail hereinbelow.

As schematically illustrated the clipper 80 may be mounted in other ways and the pivot pin 90 be eliminated. For example the clipper 80 may be mounted so that both ends may be individually moved by eliminating pivot pin 90 and providing an extension arm 98 connected to a piston and cylinder 100. The operation of the piston and cylinder 100 is controlled by the control 36 via line 102 to move the arm 98 as indicated by the arrow 104. In the latter arrangement the angular position of the clipper 80 and thereby the knife 82 relative to the path of travel 88 is controlled by the coordinated movement or operation of the piston and cylinder 92 and 100 as will be described in more detail hereinbelow.

Table I indicates that the length of veneer cut from a log or bolt with the cutting edge 70 at an angle A to the axis of rotation 34 wherein the length of the veneer in the grain direction is about 2.6 m; the large diameter end of the bolt adjacent to the chuck 20 is about 356 mm, the small diameter of the bolt adjacent to the chuck 24 is about 381 mm; and a tapered thickness veneer is cut having a thickness at the larger diameter end of the bolt of about 2.7 mm, and at the smaller diameter end of the bolt of about 2.4 mm for a nominal thickness of 2.5 mm (i.e. an average thickness of 2.5 mm).

TABLE I

Small end Bolt Diameter, mm = 356
Large End Bolt Diameter, mm = 381
Minimum Core Diameter, mm = 101
Nominal Veneer Thickness, mm = 2.5

| | Small End | | | Large End | | | |
|---|---|---|---|---|---|---|---|
| Rev No. | Veneer Thick mm | Core Dia mm | Edge Length mm | Veneer Thick mm | Core Dia mm | Edge Length mm | Length Difference mm |
| 1 | 2.413 | 353 | 1110 | 2.667 | 378 | 1189 | −79 |
| 2 | 2.413 | 348 | 1094 | 2.667 | 373 | 1172 | −78 |
| 3 | 2.413 | 344 | 1079 | 2.667 | 368 | 1155 | −76 |
| 4 | 2.413 | 339 | 1064 | 2.667 | 362 | 1138 | −74 |
| 5 | 2.413 | 334 | 1049 | 2.667 | 357 | 1122 | −73 |
| 6 | 2.413 | 329 | 1034 | 2.667 | 352 | 1105 | −71 |
| 7 | 2.413 | 324 | 1019 | 2.667 | 346 | 1088 | −69 |
| 8 | 2.413 | 319 | 1003 | 2.667 | 341 | 1071 | −68 |
| 9 | 2.413 | 316 | 988 | 2.667 | 336 | 1055 | −67 |
| 10 | 2.413 | 310 | 973 | 2.667 | 330 | 1038 | −65 |
| 11 | 2.413 | 305 | 958 | 2.667 | 325 | 1021 | −63 |
| 12 | 2.413 | 300 | 943 | 2.667 | 320 | 1004 | −61 |
| 13 | 2.413 | 295 | 928 | 2.667 | 314 | 987 | −59 |
| 14 | 2.413 | 290 | 912 | 2.667 | 309 | 971 | −59 |
| 15 | 2.413 | 286 | 897 | 2.667 | 304 | 954 | −57 |
| 16 | 2.413 | 281 | 882 | 2.667 | 298 | 937 | −55 |
| 17 | 2.413 | 276 | 867 | 2.667 | 293 | 920 | −53 |
| 18 | 2.413 | 271 | 852 | 2.667 | 288 | 904 | −52 |
| 19 | 2.413 | 266 | 837 | 2.667 | 282 | 887 | −50 |
| 20 | 2.413 | 261 | 822 | 2.667 | 277 | 870 | −48 |
| 21 | 2.413 | 257 | 806 | 2.667 | 272 | 853 | −47 |
| 22 | 2.413 | 252 | 791 | 2.667 | 266 | 837 | −46 |
| 23 | 2.413 | 247 | 776 | 2.667 | 261 | 820 | −44 |
| 24 | 2.413 | 242 | 761 | 2.667 | 256 | 803 | −42 |
| 25 | 2.413 | 237 | 746 | 2.667 | 250 | 786 | −40 |
| 26 | 2.413 | 233 | 731 | 2.667 | 245 | 770 | −39 |
| 27 | 2.413 | 228 | 715 | 2.667 | 240 | 753 | −38 |
| 28 | 2.413 | 223 | 700 | 2.667 | 234 | 736 | −36 |
| 29 | 2.413 | 218 | 685 | 2.667 | 229 | 719 | −34 |
| 30 | 2.413 | 213 | 670 | 2.667 | 224 | 703 | −33 |
| 31 | 2.413 | 208 | 655 | 2.667 | 218 | 686 | −31 |
| 32 | 2.413 | 204 | 640 | 2.667 | 213 | 669 | −29 |
| 33 | 2.413 | 199 | 624 | 2.667 | 208 | 652 | −28 |
| 34 | 2.413 | 194 | 609 | 2.667 | 202 | 636 | −27 |
| 35 | 2.413 | 189 | 594 | 2.667 | 197 | 619 | −25 |
| 36 | 2.413 | 184 | 579 | 2.667 | 192 | 602 | −23 |
| 37 | 2.413 | 179 | 564 | 2.667 | 186 | 585 | −22 |
| 38 | 2.413 | 175 | 549 | 2.667 | 181 | 569 | −20 |
| 39 | 2.413 | 170 | 533 | 2.667 | 176 | 552 | −19 |
| 40 | 2.413 | 165 | 518 | 2.667 | 170 | 535 | −17 |
| 41 | 2.413 | 160 | 503 | 2.667 | 165 | 518 | −15 |
| 42 | 2.413 | 155 | 488 | 2.667 | 160 | 502 | −14 |
| 43 | 2.413 | 150 | 473 | 2.667 | 154 | 485 | −12 |
| 44 | 2.413 | 146 | 458 | 2.667 | 149 | 468 | −10 |
| 45 | 2.413 | 141 | 442 | 2.667 | 144 | 451 | −9 |
| 46 | 2.413 | 136 | 427 | 2.667 | 138 | 434 | −7 |
| 47 | 2.413 | 131 | 412 | 2.667 | 133 | 418 | −5 |
| 48 | 2.413 | 126 | 397 | 2.667 | 128 | 401 | −4 |
| 49 | 2.413 | 122 | 382 | 2.667 | 122 | 384 | −2 |
| 50 | 2.413 | 117 | 367 | 2.667 | 117 | 367 | 0 |
| 51 | 2.413 | 112 | 352 | 2.667 | 112 | 351 | +1 |
| 52 | 2.413 | 107 | 336 | 2.667 | 106 | 334 | +2 |
| 53 | 2.413 | 102 | 321 | 2.667 | 101 | 317 | +4 |

Total Length of Veneer on Small End = 37915 mm
Total Length of Veneer on Large End = 39903 mm It will be apparent from Table I that the cutting angle Angle A is constantly changing as the diameter of the bolt changes thereby gradually reducing the difference of length between the long edge (large end edge) 74 and the short edge (short end edge) 76 of the veneer 72. Compare, for example, the first revolution which provides a length difference of about 79 mm with say the 25th revolution which produces a length difference of only 41 mm.

Thus, the amount of correction necessary (angle of the clipping knife to the axis of rotation of the bolt) is reduced as peeling continues.

Table II, is an example of seven consecutive clips illustrating one example of how a correction may be applied. In the particular example shown in Table II clip number 1 is the starting clip.

TABLE II

| Clipping Cut No. | Min Arc Length from Prev Cut, m | Accum Diff. in Edge Lengths mm | Correct Applied mm | Cumulat Correct mm | Correct Diff. in Edge Lengths mm |
|---|---|---|---|---|---|
| 1 | | | Starting Cut | | |
| 2 | 1.3 | 94 | — | | 94 |
| 3 | 1.3 | 188 | — | | 188 |
| 4 | 0.65 | 235 | 100 | 100 | 135 |
| 5 | 0.65 | 280 | 100 | 200 | 80 |
| 6 | 1.3 | 372 | — | 200 | 172 |
| 7 | 0.65 | 417 | 100 | 300 | 117 |

A full panel 100 is formed between clip No. 1 and clip No. 2 and therefore clip No. 1 and 2 are parallel. To form clip No. 2 parellel to clip No. 1 requires that the angular position of the knife 82 to the path of travel 88 be adjusted to compensate for the 94 m difference in length of the arc between the minimum diameter arc and the maximum diameter arc, i.e. the arc formed by the edge 76 and that formed by the edge 74 so that cut number 2 will be substantially parallel to cut number 1. Obviously the arc lengths on the ends of the panel 100 formed by the edges 74 and 76 will not be equal but the edges formed by clips No. 1 and 2 will be parallel and spaced by say 1.3 m.

Clip number 3 is spaced a complete panel length from clip No. 2 and thus the edge 82 must be angularly adjusted from the position to form clip 2 so that clip No. 3 is parallel to clip number 2, i.e. the angular position of edge 82 must be adjusted to compensate for the 188.5 mm difference in length between the edge 76 and 74 accumulated over the two panels 100 and 200. Keeping in mind that it had already been adjusted to compensate for the 94 mm difference for panel 100 the adjustment necessary between cut numbers 2 and 3 is equivalent to again the 94 mm (188 mm minus 94 mm=94 mm) difference in length of the edges 74 and 76 of panel 200.

On the next clip, clip number 4 a partial panel 300 is being produced, in this case, a panel of say 0.65 m measured adjacent the minimum arc edge 76. At this point (location of clip 4) the accumulated difference between the length of edges 74 and 76 is 235 mm, however, the angle of the edge 82 for clip No. 4 is not adjusted to cut parallel to clip 3 but is adjusted so that the angle of the knife 82 to the clip No. 3 is such that resultant partial panel 300 is tapered and is say 100 mm longer along the edge 74 than along the edge 76 thereby providing a 100 mm correction to reduce the accumulated difference in length between the edges 74 and 76 to 135 mm.

Clip number 5 forms a partial panel 400 and provides a further correction of 100 mm, i.e. the angle of the blade 82 is adjusted so that the clip No. 5 is at an acute angle to the edge formed by clip No. 4 and extends 100 mm longer along edge 74 than along edge 76 so that a total accumulated correction of 200 mm has been applied and the difference in accumulated lengths of the two edges 74 and 76 at clip No. 5 is reduced to 80.

Stated another way in the particular example being described the arc distance along edge 76 between clips 4 and 5 is about 650 mm and the length between the clips 4 and 5 measured along the edge 74 is about 750 mm.

In the particular example, clip number 6 forms a full panel 500 thus clip member 6 is parallel to clip number 5 and total accumulated difference in length between edges 74 and 76 is 372 mm less the total correction applied of 200 mm leaving 172 mm.

Clip number 7 forms a partial panel 600 and supplies another correction; at this point the total accumulated difference in length between edge 74 and 76 is 417 mm, the correction applied is a further 100 mm for a total correction of 300 mm and a corrected difference in edge lengths of 117 mm.

It will be apparent that, if desired, the first panel 100, i.e. clip number 2 could have been a partial panel and a correction could have been applied at clip 2 which would have resulted in a correction greater than the accumulated difference in edge length (assuming the 100 mm correction) so that the end of the knife 82 adjacent to the edge 74 would have had to move in a direction opposite to the direction of movement of the veneer assuming it is started at a position parallel to the axis 34.

It will be apparent from the above examples that significant differences in edge lengths may be tolerated before a correction is made, however, it is preferred to ensure that maximum corrected difference in length between edge 74 and 76 not exceed about 250 mm, and generally, will be less than 200 mm.

Figure 3:
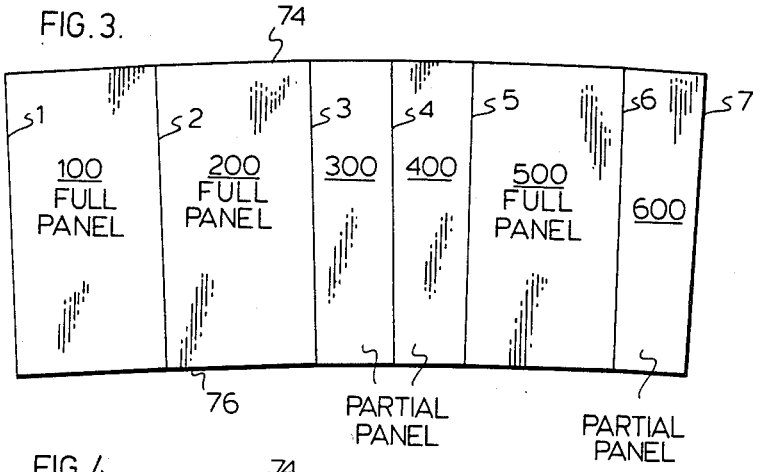
FIG. 3 is a plan view of a continuous sheet of veneer illustrating one clipping strategy incorporating the present invention.

The clipping sequence illustrated FIG. 3 by clips numbered 1, 2, 3, 4, 5, 6 and 7 illustrate the shape of the panels and size of panels produced when cutting according to the cutting scenario described in Table II.

Figure 4:
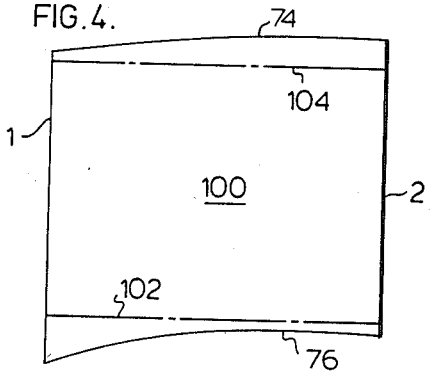
FIG. 4 is a plan view of a full panel clipped in accordance with the present invention.

FIG. 4 illustrates a full panel formed in accordance with the present invention and provides a better indication of the shape of the panels. The two edges formed by the clips No. 1 and 2 on the first full panel 100 are parallel. It is important that the length of clips 1 and 2, i.e. the length of the veneer in the grain direction be sufficiently long so that the panel cut therefrom after trimming as indicated by the cut lines shown as dot-dash lines 102 and 104 can be spaced sufficiently to form a complete panel. The panel 100 as illustrated in this particular example is rectangular with the lines 102 and 104 substantially perpendicular to the clipped edges 1 and 2 of panel 100.

It will be apparent that the full panels 200 between the clip lines 2 and 3 and full panel 500 between the clip lines 5 and 6 will be essentially the same as the panel 100 shown in FIG. 4.

Figure 5:
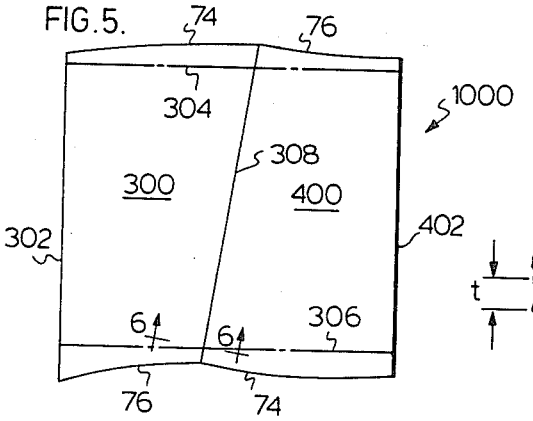
FIG. 5 is a plan view of a pair of partial panels combined to form fabricated full panel.

FIG. 5 illustrates two partial panels 300 and 400 rearranged end for end so that the curved convex edge 74 of panel 300 combines with the concave edge 76 (shorter edge) of the panel 400 and vice versa so that the two outer edges of the combined full panel 1000 formed from panels 300 and 400 are parallel as indicated at 302 and 402.

To ensure that the edges of a combined panel formed by two partial panels are parallel it is necessary that the angular adjustment, i.e. the angle between the leading side and trailing side of each partial panel be the same in all cases and when one panel is flipped over to bring its side 76 adjacent the side 74 of the other panel two outside edges 302 and 402 are automatically parallel. After trimming along the lines 304 and 306 a rectangular full panel is produced.

Figure 6:
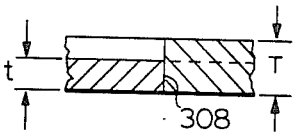
FIG. 6 is a section along the line of 6—6 of FIG. 5 illustrating the difference in thickness between the two adjacent partial tapered veneer portions.

It will be noted that in the illustrated panel 1000 the veneer is slightly thicker adjacent the edge 74 than it is adjacent the edge 76 as indicated by the thicknesses T and t in FIG. 6 and these will be a step formed at the joining line 308 between panels 300 and 400 (FIGS. 5 and 6) adjacent to each end of the edges 74 and 76. However at the center of line 308, i.e. midway between the cut lines 304 and 306 the two panels 300 and 400 will be essentially the same thickness.

The difference in thickness between dimension T minus t is not sufficient to interfere with the manufacture of a layup in making a plywood panel.

It will be apparent that the description given above simplifies the mathematics involved in that it does not take into account automatic correction provided by the difference in arc length between the edges 76 and 74 between clips for example on full panels, i.e. the chord distance between the clips 1 and 2 as represented by the lines 102 and 104 in FIG. 4 must be equal but the arc lengths on the edges 74 and 76 between the two clips 1 and 2 may each differ from the length of cut lines 102 and 104 by different amounts. Thus, the accumulated differences will be slightly less than that indicated in Table I but the computer program designed to control the position of the blade 82 for each cut will be programmed to accommodate this difference. In particular, the program will operate the blade on the cord length as defined, for example, by the cut length of 102 or 104 and will ensure that the cut length 102 and 104 is long enough to form a full panel with trim.

Obviously when a defect is to be removed using the standard or well known sensor and clipping strategy the operation of the present invention will be recommended after each defect is removed. Clipping to remove a defect will, when practicing the present invention, be used to apply a degree of correction, i.e. by clipping out a wedge shape at the defect.

Having described the invention, modifications will be evident to those skilled in the art without departing from the spirit of the invention as defined in the appended claims.

I claim:

1. A method of trimming veneer peeled on a taper so that said peeler veneer has a longer side edge and an opposed shorter side edge into discrete full or partial veneer panels, each said veneer panel defined on two sides by said longer and shorter side edges and by a leading and a trailing edge formed by clipping with a clipping knife comprising adjusting the angle of the clipping knife to the normal path of travel of said veneer to clip said veneer into full paels each having its respective leading and trailing edges substantially parallel and into partial panels each having its trailing edge at an acute angle to its respective leading edge and flowing from said its shorter side to its longer side to tend to reduce the accumulated difference in length between said shorter and said longer sides.

2. Method as defined in claim 1 wherein said acute angle for each of said partial panels is substantially the same so that a pair of said panels may be arranged with the narrow end of one of said pair of panels adjacent to the wider end of the other of said pair of panels to form a fabricated panel having a pair of opposed parallel edges.

3. A method as defined in claim 2 wherein said partial panels are substantially half the size of a full panel whereby when two said partial panels are combined they form an equivalent of one full panel.

4. A method of forming discrete panels from taper peeled veneer comprising feeding a bolt to a sensing position, sensing the size and shape of said bolt, centering said bolt for rotation around a longitudinal axis determined in said sensing position, rotating said bolt around said longitudinal axis, adjusting the angular relationship of a cutting edge of a peeling knife to said axis of rotation to peel veneer with said cutting edge at an acute angle to said axis of rotation to provide a veneer having a longer curved edge and an opposed shorter curved edge, clipping said peeled veneer into full and partial panels as defined by opposed section of said longer and shorter curved edges and a leading and a trailing clipped edge by a clipper knife adjusting the angular relationship of said clipper knife to a path of travel of said veneer to clip said veneer into full panels having their leading and trailing edges substantially parallel and partial panels having their trailing edge at an acute angle to their leading edge and flowing from this shorter toward thin longer curved edge.

5. Method as defined in claim 4 wherein the acute angles of each of said partial panels is substantially the same.

6. An apparatus for peeling veneer comprising means to rotate a tapered wood bolt on an axis of rotation, a peeler knife means to peel veneer from said bolt, means to advance said knife with its cutting edge at an acute angle to said axis of rotation to cut a veneer having an edge formed at the larger diameter end of said tapered bolt longer than the edge formed at the shorter diameter end of said tapered bolt, a clipper means having a clipping edge mounted to permit angular adjustment of said clipping edge to said axis of rotation and means for adjusting the angular relationship of said clipper edge with said axis of rotation.

7. An apparatus as defined in claim 6 further comprising computer means for determining the difference in length between said longer and said shorter edges, said computer means controlling said means to adjust to adjust said angular relationshp of said clipping edge to said axis rotation in accordance with the then current accumulated difference in length between said long and said short edges.

* * * * *